US008827545B2

(12) United States Patent
Kalidindi

(10) Patent No.: US 8,827,545 B2
(45) Date of Patent: Sep. 9, 2014

(54) APPARATUS FOR ALTERNATELY SIFTING AND BLENDING POWDERS IN THE SAME OPERATION

(76) Inventor: Sanyasi R. Kalidindi, East Brunswick, NJ (US)

( * ) Notice: Subject to any disclaimer, the term of this patent is extended or adjusted under 35 U.S.C. 154(b) by 134 days.

(21) Appl. No.: 13/596,086

(22) Filed: Aug. 28, 2012

(65) Prior Publication Data

US 2014/0064020 A1 Mar. 6, 2014

(51) Int. Cl.
*B01F 9/08* (2006.01)

(52) U.S. Cl.
USPC ..... 366/224; 209/296; 366/226

(58) Field of Classification Search
CPC .... B01F 9/08; B01F 7/00558; B01F 7/00608; B01F 7/00616
USPC ..... 366/222, 223, 224, 226; 209/280, 296, 209/304
See application file for complete search history.

(56) References Cited

U.S. PATENT DOCUMENTS

| | | | | |
|---|---|---|---|---|
| 15,455 | A | 7/1856 | Mendenhall et al. | |
| 74,954 | A | 2/1868 | Tingley | |
| 79,821 | A | 7/1868 | Gilbert | |
| 99,985 | A | 2/1870 | Wegner et al. | |
| 192,540 | A | 6/1877 | Stoll | |
| 269,129 | A | 12/1882 | Smith | |
| 400,621 | A | 4/1889 | Winkler | |
| 1,593,312 | A | 5/1926 | Shappell | |
| 2,285,721 | A * | 6/1942 | Karp | 241/88 |
| 2,677,534 | A * | 5/1954 | Fischer et al. | 366/235 |
| 2,908,487 | A * | 10/1959 | Fischer | 366/170.1 |
| 6,142,095 | A | 11/2000 | Long | |
| 6,308,704 | B1 | 10/2001 | Wennerberg | |
| 6,776,517 | B2 | 8/2004 | Afnan et al. | |
| 7,056,010 | B2 | 6/2006 | Davies | |
| 7,942,353 | B2 * | 5/2011 | Cerra et al. | 241/73 |
| 8,235,582 | B2 | 8/2012 | Kalidindi | |
| 2010/0085834 | A1 * | 4/2010 | Kalidindi | 366/226 |
| 2010/0149903 | A1 | 6/2010 | Imai et al. | |

FOREIGN PATENT DOCUMENTS

| | | |
|---|---|---|
| GB | 875901 | 8/1961 |
| KR | 100140014 | 3/1998 |
| KR | 10-0359593 | 10/2002 |
| KR | 1020060084459 | 7/2006 |
| KR | 10-2008-0027817 | 3/2008 |

* cited by examiner

*Primary Examiner* — Charles Cooley
*Assistant Examiner* — Marc C Howell
(74) *Attorney, Agent, or Firm* — Michael R. Philips

(57) ABSTRACT

A tumbling container is mounted for rotation with a curved screen fixedly mounted within the tumbling container. A multiple vane paddle is mounted to a shaft that is rotatably mounted to the tumbling container. The paddle vanes are formed with angular edges. As the tumbler rotates and the paddle rotates, powder is repeatedly dropped onto the screen to be sifted with the aid of the paddle. Rotating the tumbler further drops unsifted portions of the powder from the screen to mix with additional powder in the tumbler body. Thus, sifting and blending of powders is accomplished in one single operation. The invention utilizes an apparatus having a multiple section screen and a multiple section paddle to enable assembly through the openings in the tumbling container. The screen of a second embodiment has a cowl adjacent to each screen opening to optimize powder lump disintegration.

21 Claims, 6 Drawing Sheets

PRIOR ART
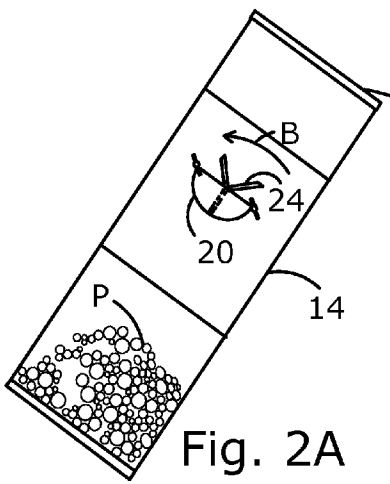
Fig. 2A
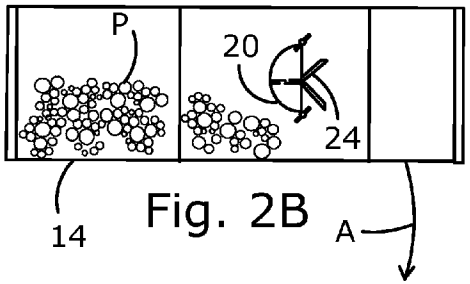
Fig. 2B
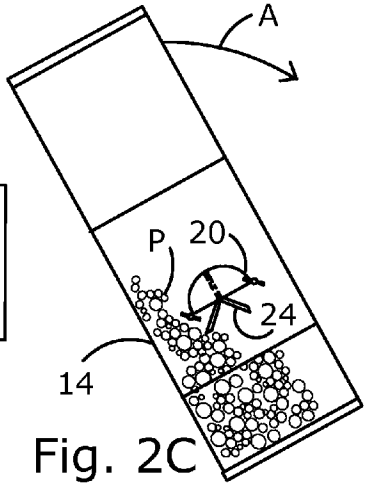
Fig. 2C
Fig. 2D
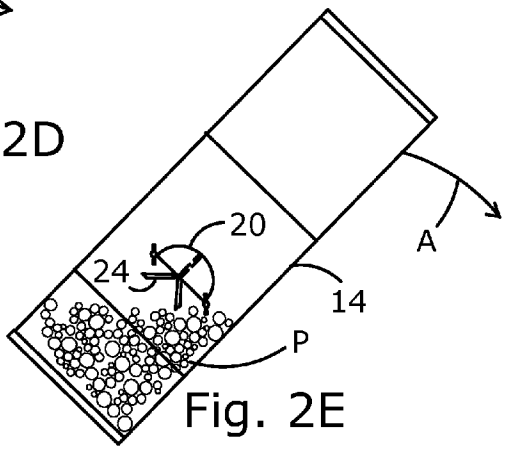
Fig. 2E
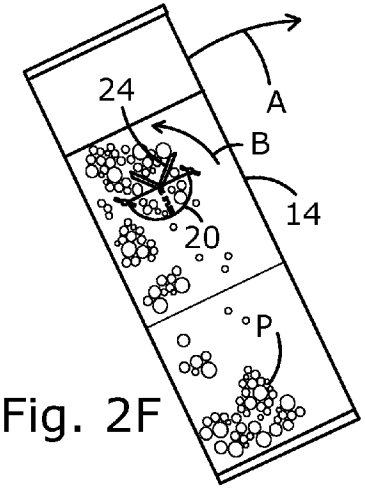
Fig. 2F

APPARATUS FOR ALTERNATELY SIFTING AND BLENDING POWDERS IN THE SAME OPERATION

FIELD OF THE INVENTION

The present invention relates to the field of powder processing, and more particularly to an apparatus for alternately sifting and blending a mix of powders in the same operation.

BACKGROUND OF THE INVENTION

Many pharmaceutical products are made by blending several powders in production quantities. Careful control is essential to ensure uniformity within a given batch and from one batch to another. A typical pharmaceutical may involve five or more ingredients in powder form. It is not uncommon for one or more of the powder ingredients to contain lumps, i.e. a quantity of the powder stuck together, that must be disintegrated to enable uniform blending with other ingredients. Often there is only one active ingredient that comprises a very small fraction of the total ingredients to be combined, typically measured in micrograms or milligrams. Unless the mixing is thorough, parts of the production batch will have an insufficient amount of active ingredient to be effective, and parts of the production batch will have an excess amount of active ingredient and could be detrimental. In many cases, when the blending is complete the powder is either compressed into tablets or filled into capsules to provide measured dose quantities.

Blending of powders is commonly done in a tumbler, a closed container that is rotated, typically end over end, to mix the multiple powder ingredients to form a homogeneous blend. A known type blender that effectively mixes powders is known as a V-blender or a double cone blender. Many tumbling blenders include an intensifier bar that is rotated at high speed within the blender. Using a tumbling blender, such as a V-blender with an intensifier bar, yields a more uniform blend than a stationary blender, such as a ribbon blender. However, even blending of a micronized active ingredient with other ingredients in a tumbling blender with an intensifier bar does not always yield a uniform blend. In some situations, a micronized active ingredient will develop a static charge and form small aggregates, or lumps, which do not break up during the blending process, even with an intensifier bar. To correct the problem of aggregated powder, the powder batch may be first blended, then removed from the blender and sifted or milled, and then re-loaded into the blender to be blended again. This multiple handling process is time consuming and generates dust from the powder ingredients.

U.S. Pat. No. 8,235,582 was issued Aug. 7, 2012 to the present inventor for a METHOD FOR ALTERNATELY SIFTING AND BLENDING POWDERS IN THE SAME OPERATION. Whereas the '582 patent teaches a useful and unique method, it has been determined that in large equipment for sifting and blending powders, e.g. typically on the order of 150 kg to 2000 kg powder capacity, it is difficult or impossible to install and remove a single piece screen and single piece paddle as described above through the cover openings in the tumbling container.

SUMMARY OF THE INVENTION

The present invention provides an improved apparatus for efficiently sifting and blending powders thoroughly in a single operation. The invention apparatus has an arcuate screen that is mounted within a tumbler. As the blender tumbles end over end, the powders in the blender are dropped onto the concave surface of the arcuate screen to be sifted for improved mixing. A paddle agitator is mounted for rotation concentrically within the screen to provide additional powder mixing by breaking down the powder lumps and pushing the powder through the screen. The screen and the agitator are each formed in multiple sections to enable easier mounting, assembly inside the blender than would be possible with single section components, especially so in large blenders. The sections of screen and agitator are individually inserted and then assembled within the tumbler, which is also safer for the operator. Multiple sections also simplify removal for maintenance and cleaning. Additionally, replacement of a damaged or worn out segment would be less expensive than replacing the entire screen or the agitator.

BRIEF DESCRIPTION OF THE DRAWINGS

The present invention is best understood in conjunction with the accompanying drawing figures in which like elements are identified by similar reference numerals. For full integration, FIGS. 1-5 describe the apparatus utilized in the '582 patent method.

FIGS. 2A-2F are a series of side elevation views taken in the direction indicated by line 2-2 of FIG. 1 to portray the steps of the invention method.

DETAILED DESCRIPTION OF THE PREFERRED EMBODIMENTS

Figure 1:
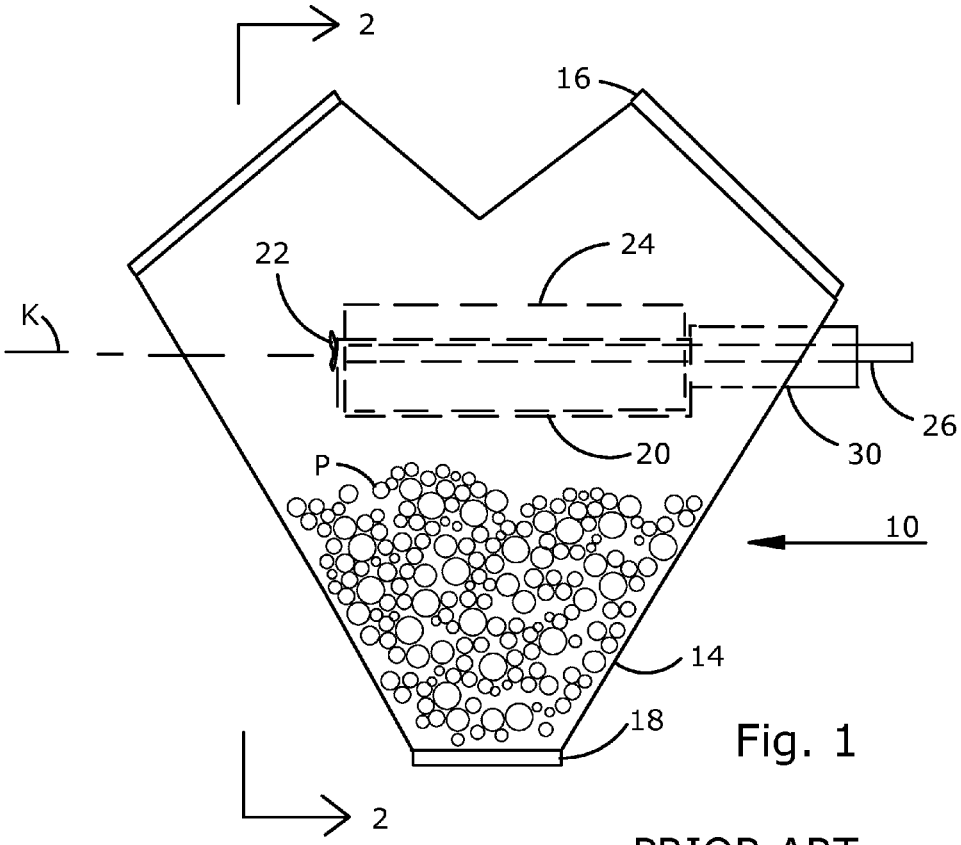
Fig. 1 PRIOR ART
FIG. 1 is a front elevation view of the apparatus for sifting and blending powders as utilizing a V-blender type tumbler.

Referring to FIG. 1, an apparatus 10 used for sifting and blending powders is shown in front elevation. A tumbler 14, e.g. a V-blender, is shown in upright orientation. V-blenders, as are known, are effective by dividing and re-combining the powders as the blender rotates end over end. While the preferred embodiment of the invention incorporates a V-blender, the principles disclosed herein are deemed to pertain to various tumbling blender geometries. Tumbler 14 is mounted for rotation around axis K. A pair of top closures 16 and a bottom closure 18 are mounted to the top and bottom respectively of tumbler 14 to contain ingredients therein. A trunnion 30 is fixedly mounted to the wall of tumbler 14 to be concentric with axis K with a portion of trunnion 30 extending into the free space within tumbler 14. A semi-tubular screen 20 is fixedly mounted to trunnion 30 by means of a plurality of fasteners 22, e.g. long shafted screws. A drive shaft 26 which passes through a bore through trunnion 30 with an attached agitator, preferably a paddle 24, is movably mounted to the inner end thereof. A first drive device (not shown) is connected to rotate trunnion 30 and tumbler 14, and a second drive device (not shown) is connected to rotate shaft 26 and paddle 24. In this manner, tumbler 14 may be rotated at a different speed, e.g. slower, than paddle 24. Alternately, tumbler 14 and paddle 24 may be rotated in opposite directions. A batch of powder P resides at about 60% of the volume of tumbler 14.

Referring now to FIGS. 2A-2F, tumbler 14 is shown in sequential side elevation views as rotating in the direction indicated by arrow A. FIGS. 2A-2F are taken in the direction indicated by line 2-2 of FIG. 1 in order to show the interior screen and paddle features thereof more clearly. FIG. 2A portrays tumbler 14 with screen 20 fixedly mounted thereto and paddle 24 rotatably mounted therein. FIG. 2A shows tumbler 14 in a first angular orientation beginning the process of being rotated to sift and blend powder P held therein. The batch of powder P is beginning to shift toward the right side of tumbler 14. Whereas tumbler 14 and screen 20 are fixedly connected, screen 20 turns at the same speed as tumbler 14 in direction A. Paddle 24 is driven to rotate in the direction indicated by arrow B, i.e. opposite to the rotational direction of tumbler 14 and screen 20. In this manner, the effectiveness of paddle 24 in agitating and sifting powder through screen 20, and the effectiveness of mixing powder, is improved. While illustrated with paddle 24 rotating in a direction opposite to the direction of tumbler 14, a rotation in the same direction as tumbler 14, or at the same or different speed as tumbler 14, may be useful in various production situations. FIG. 2B shows tumbler 14 is in a substantially horizontal orientation with powder P resting on a side (shown as the bottom) of tumbler 14. FIG. 2C shows tumbler 14 approaching complete vertical inversion, with powder P falling past screen 20. FIG. 2D shows tumbler 14 in fully vertical inverted orientation with the batch of powder P having passed screen 20. FIG. 2E shows tumbler 14 beyond the inverted position with powder P partly in contact with the sidewall and partly in contact with the end of tumbler 14 opposite to the open end of screen 20. In FIG. 2F, tumbler 14 is approaching the vertically upright orientation with a significant portion of powder P dropping into screen 20 and additional portions of powder P dropping past screen 20. The portion of powder P caught in screen 20 is sifted with the aid of paddle 24 to fall through screen 20 and merge with the portion of powder P at the bottom of tumbler 14. With each rotation of tumbler 14, a different portion of powder P is sifted through screen 20 and other portions of powder P are tumbled in a repetitive sifting and blending operation. Whereas tumbler 14 is being continuously rotated, only some of the portion of powder P caught in screen 20 will be sifted through screen 20 by the time tumbler 14 rotates and drops the unsifted portion of powder P from screen 20.

Figure 3:
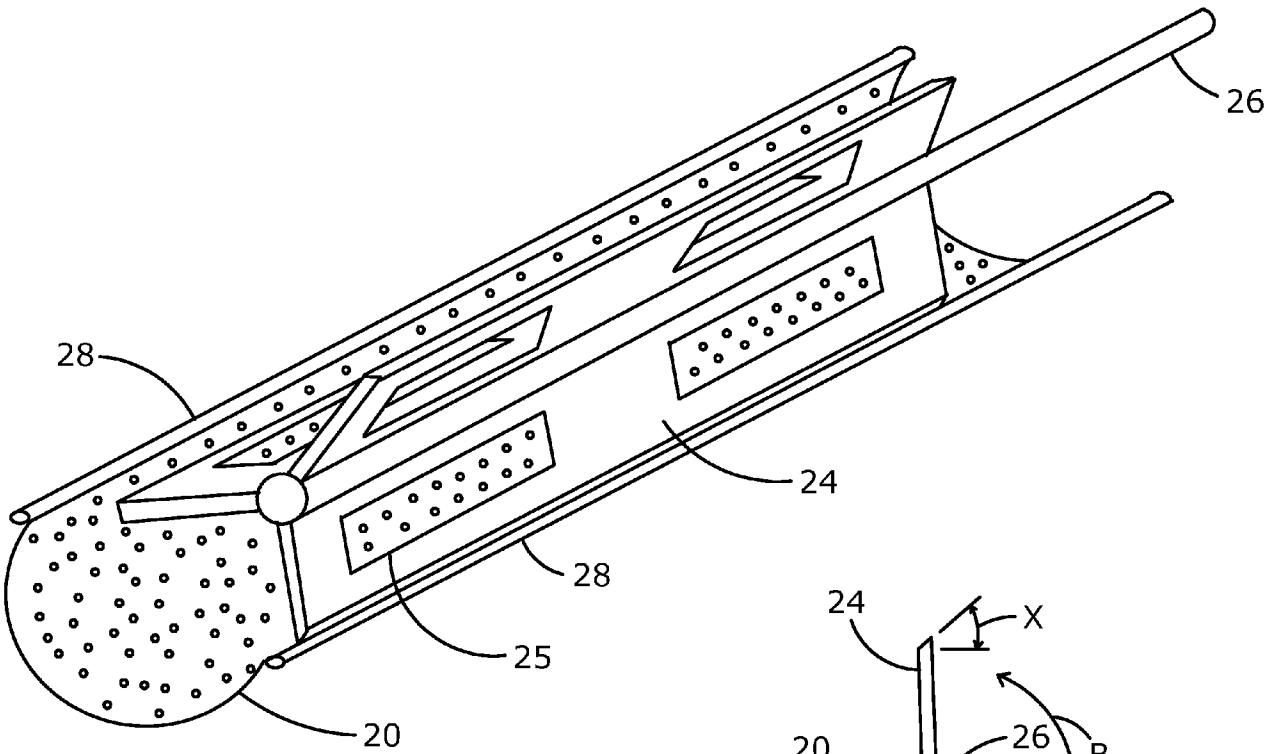
FIG. 3 is a perspective view of a screen and paddle used in the sifting and blending apparatus.

Referring now to FIG. 3, screen 20 and paddle 24 mounted on shaft 26 are shown in perspective view. Screen 20 in the preferred embodiment is formed of a sheet of type 306 stainless steel, with the thickness of the sheet dependent on the size of tumbler used. Alternate materials may be used for screen 20 depending on the design purpose of the apparatus, including plastic resins. Screen 20 as a sheet structure is formed with a plurality of openings therethrough of a size to allow appropriate size particles to pass and be sifted, or separated. Screen 20 is preferably in a semi-tubular shape, i.e. with a uniform radius concentric to axis K (see FIG. 1) to conform to the turning radius of paddle 24 and maintain a maximum opening at the top of screen 20. A pair of channels 28 are formed along the upper edges of screen 20 to receive fasteners 22 (see FIG. 1), with channels 28 residing diametrically outside of screen 20. Alternatively, screen 20 may be formed from a woven wire screen and/or formed in an arcuate or spherical shape, with paddle 24 shaped appropriately. Paddle 24 is preferably formed with a plurality of blades, e.g. 3 blades, each blade having one or more windows 25 formed therethrough. The windows 25 help to break down hard lumps and serve as passages to permit a portion of powder to pass through and a portion of powder adjacent to a solid frame section to be pushed forward, thus mixing the powder further. In an alternate embodiment, paddle 24 may be replaced with an auger type mixer that is substantially equal in diameter to the inside of screen 20. In the embodiment where paddle 24 may be replaced with an auger, windows may be provided to serve similar purposes.

Figure 4:
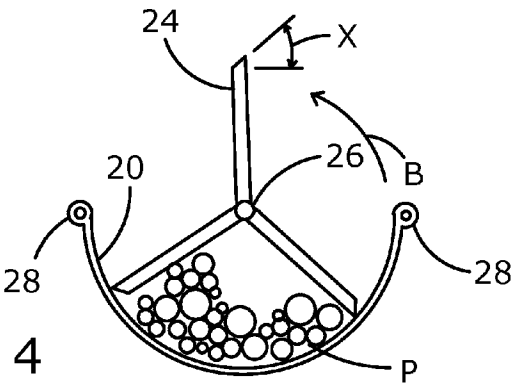
Fig. 4 PRIOR ART
FIG. 4 is an end elevation view of the screen and paddle with a quantity of powders held therein.

Referring now to FIG. 4, screen 20 and paddle 24 are shown in end elevation view with a quantity of powder P being mixed thereby with channels 28 outside the structure of screen 20 to avoid contact with paddle 24. In a further feature of the invention, distal edge portions of each blade of paddle 24 are formed at an angle X to the length of the blade in the radius direction, angle X being preferably in the range of 10° to 45°. Angle X is oriented opposed to rotational direction B of paddle 24 so that as each blade passes screen 20, angle X presses some powder P through openings in screen 20 in a sifting operation. Forming the outer edge of each blade of paddle 24 at angle X further aids in the process of finely coating particles of powder P with a lubricating or protective layer, or coating fine particles of active ingredient on larger particles of inactive ingredient. To provide optimum effect of the angled blade edge, paddle 24 is mounted to place the edge of each blade in close proximity to screen 20. As portions of each blade edge pass over the areas of screen 20 between openings, the powder particulate and coating material are rolled and squeezed into intimate contact to optimize the adhesion therebetween.

Figure 5:
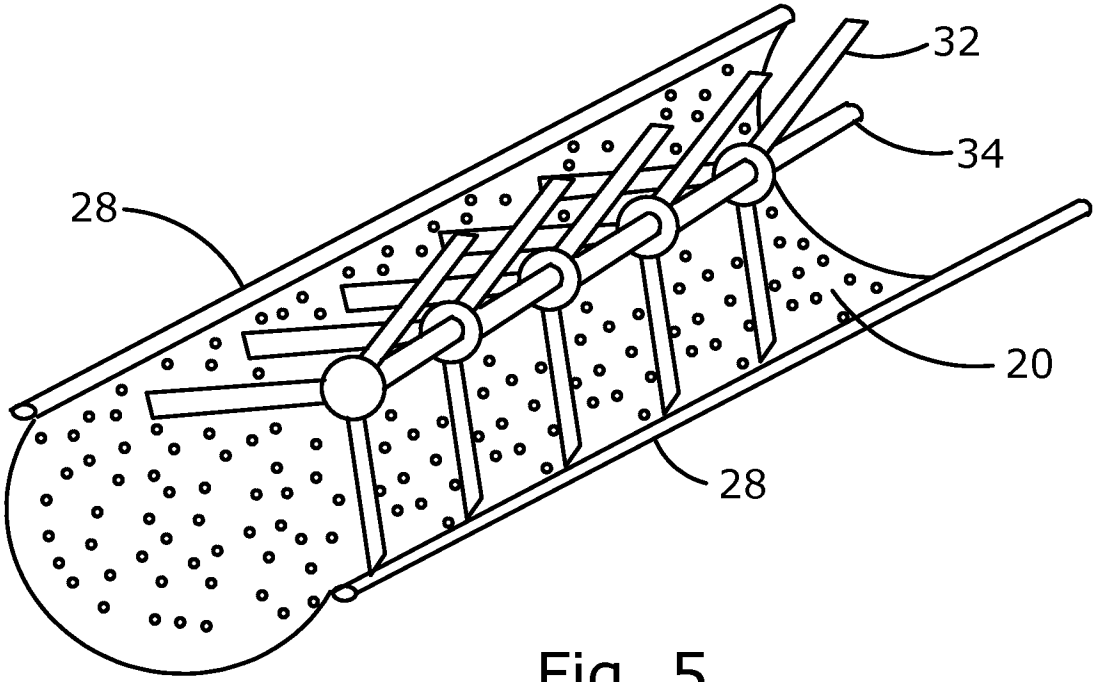
Fig. 5 PRIOR ART
FIG. 5 is a perspective view of a screen and cutter used in the sifting and blending apparatus.

Referring now to FIG. 5, a variation of the apparatus is illustrated in perspective view. Screen 20 is formed in an arcuate or semi-tubular shape with a channel 28 on opposed edges thereof. A series of cutters 32 are mounted radially on a shaft 34 that is mounted concentric with screen 20 and rotated. Cutters 32 may be tapered on one longitudinal edge to form a sharp leading edge for cutting hard lumps into smaller pieces or granules and the other longitudinal edge may be blunt for reducing the particle size of one or more of the ingredients before starting the blending operation or while the blending operation is in progress. The direction of rotation of the cutters may be forward or reverse depending upon whether the sharp edge or the blunt edge is to be operational.

Figure 6:
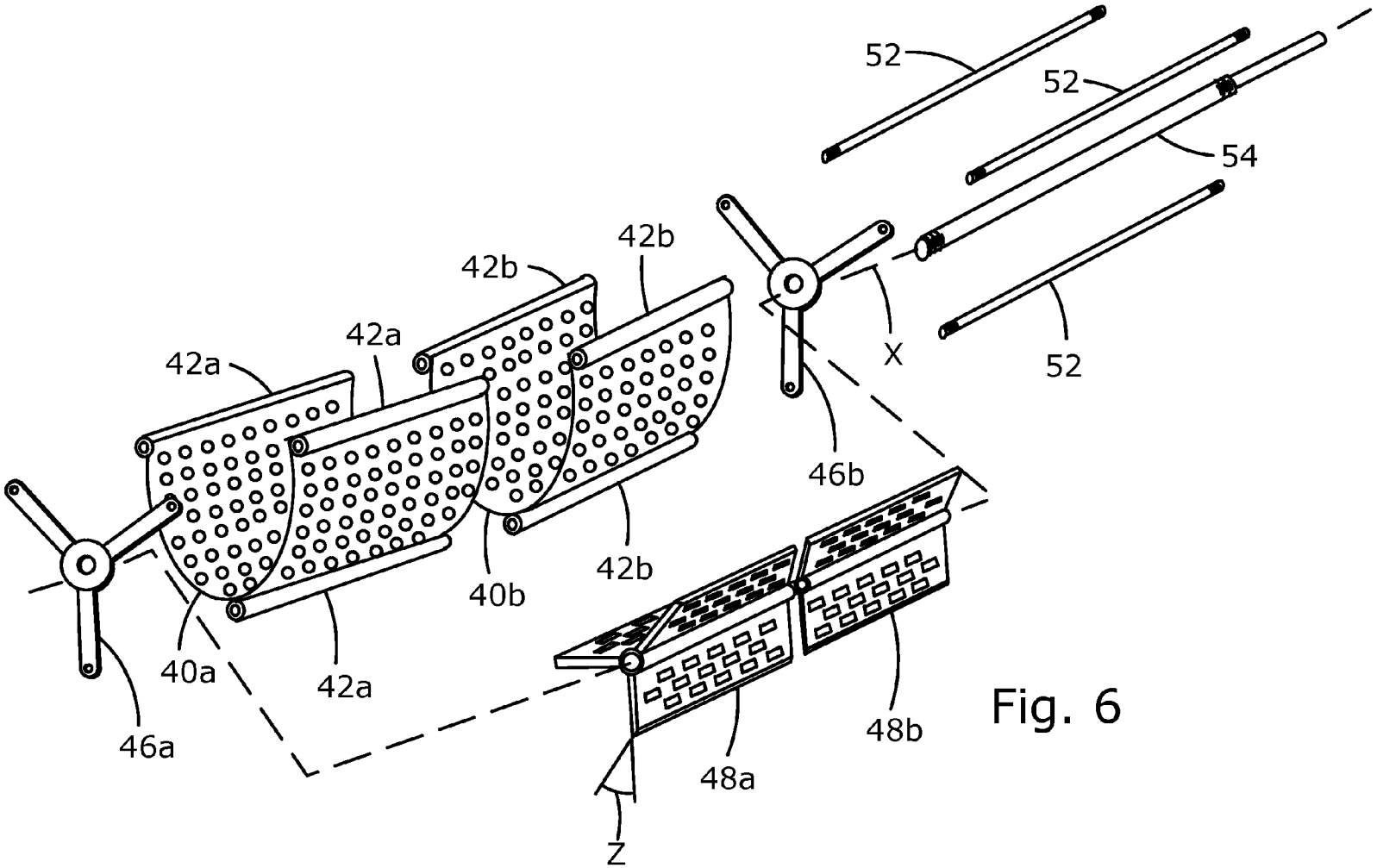
FIG. 6 is an exploded perspective view of a multiple section screen and multiple section paddle according to the present invention.

Referring now to FIG. 6, a multiple section screen and a multiple section paddle according to the present invention are shown in exploded perspective view. As noted above, in large size tumbling equipment for sifting and blending powders, e.g. on the order of 150 kg to 2000 kg powder capacity, it is difficult or impossible to install and remove a single piece screen and single piece paddle as described above through the access openings in the tumbling container, because of the size and the weight of these components. If the screen and paddle are each a single large piece and therefore must remain permanently within the container, repair operations as well as the process of cleaning powder residue from the equipment between production batches is both difficult and unreliable. When sequential batches of pharmaceutical powder mix are for different drugs, residue left in the tumbling container from an earlier batch will become blended into a later batch, possibly with dangerous results. Therefore, a screen **40*a*, 40*b* of the third preferred embodiment is provided in multiple sections. The sections of screen 40*a*, 40*b* are configured around a curve, e.g. arcuate, and are small and light enough to be passed through the access openings in tumbling container 14 (see FIG. 1), to be assembled therewithin such that screen sections 40***a*, 40*b* are mounted side by side along axis X. Whereas screen 40*a*, 40*b* is depicted as being formed of two sections that are substantially equal in size, it is understood that different numbers of sections and different section sizes are considered to be within the spirit and scope of the invention.

Referring further to FIG. 6, typical screen section 40*a* is formed of a perforated sheet that is bent into the shape of a partial cylinder. The perforations through screen section 40*a* may be simple openings or may be openings with radially extended rims in the manner of a vegetable grater to improve the efficiency of disintegrating lumps of powder, to be described in detail below. A series of sleeves 42*a* are fixedly mounted to the outer surface of screen 40*a* in parallel with an axis X of screen 40*a*, e.g. by welding. A pair of end frames 46*a*, 46*b* are positioned adjacent to opposed ends of screens 40*a*, 40*b* with an opening through each of the radial arms of end frames 46*a*, 46*b* positioned to match the spacing of sleeves 42*a*, 42*b*. Each end frame 46*a*, 46*b* also has a central opening that aligns with axis X when the openings in the end frame arms are aligned with sleeves 42*a*, 42*b*. When assembled, screen sections 40*a*, 40*b* and end frames 46*a*, 46*b* are in linear alignment along axis X.

Continuing with reference to FIG. 6, an agitator, e.g. paddle 48*a*, 48*b* is provided in multiple sections. Multiple section paddle 48*a*, 48*b* has three vanes that are equally spaced around, and fixedly connected to, a central sleeve. With the central sleeve aligned along axis X and paddle sections 48*a*, 48*b* within screen 40*a*, 40*b*, the vanes of paddle sections 48*a*, 48*b* are positioned proximal to, but not touching, screen 40*a*, 40*b*. The outer edges of the vanes are preferably formed at an angle Z to the radial vane surfaces to enhance the disintegration of powder lumps. Whereas paddle sections 48*a*, 48*b* must rotate to perform the function of sifting and blending, means are provided to engage paddle section 48*a* with paddle section 48*b* for synchronous rotation, e.g. locking keys to shaft 54. Each of the vanes of paddle sections 48*a*, 48*b* are formed with an array of openings therethrough to enhance the process of mixing powder thereby. A paddle section having a different number of vanes, e.g. 2 vanes, is considered within the scope of the present invention.

Referring further to FIG. 6, a set of rods 52 are sized for insertion through the end holes of end frame 46*b*, sleeve 42*b*, sleeve 42*a* and the end holes of end frame 46*a* in a manner to create an integrated screen assembly. Shaft 54 fits through the central opening in end frame 46*b*, paddles 48*b*, 48*a* and end frame 46*a* to position paddles 48*b*, 48*a* for rotation within screens 40*b*, 40*a*. Appropriate fasteners are affixed to rods 52 and shaft 54 for secure assembly.

Figure 7:
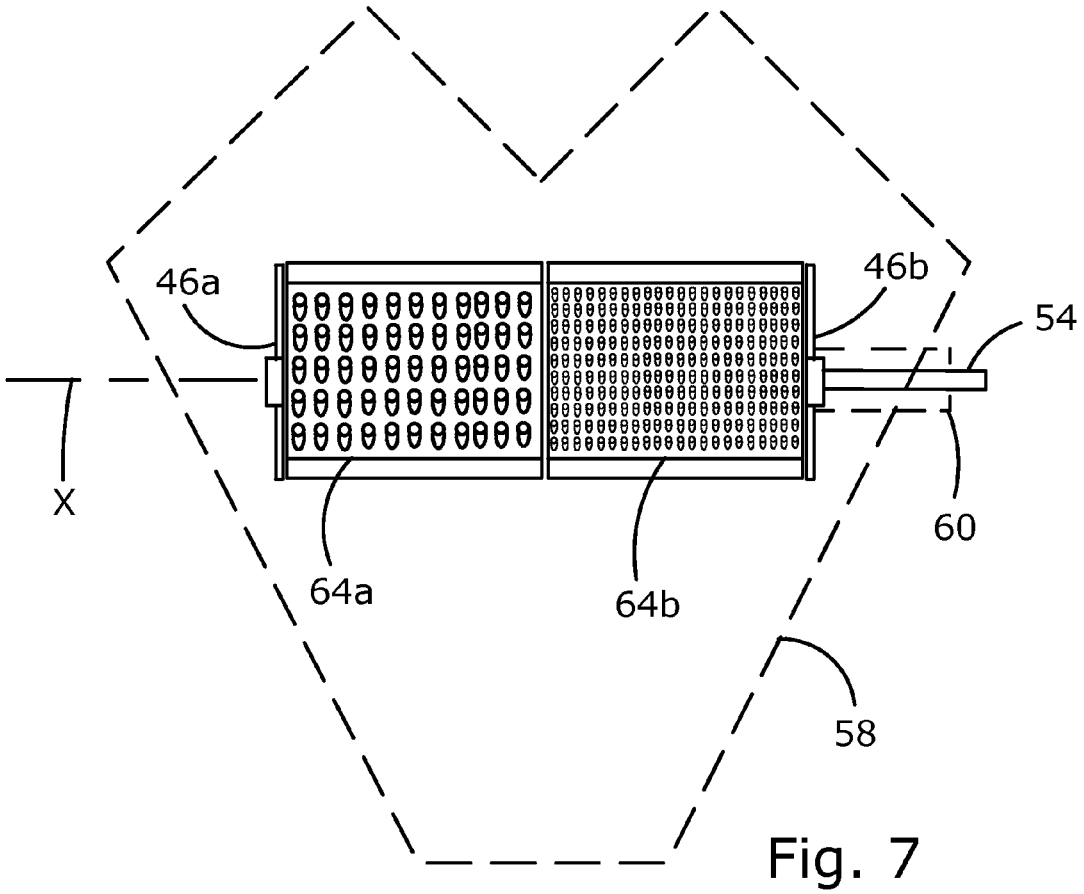
FIG. 7 is a front elevation view of the multiple section screen and paddle of a second embodiment assembled and mounted in a V-blender type tumbler, the tumbler shown in dashed lines for clarity.

Referring now to FIG. 7, the apparatus for alternately sifting and blending powders is illustrated in side elevation view as fully assembled according to a second embodiment. The apparatus shown comprises grating screen sections 64*a*, 64*b* abutting one another and mounted between end frames 46*a*, 46*b* on shaft 54. Grating screens 64*a*, 64*b* are formed with an array of openings, each opening having a cowl formed adjacent thereto, as will be described below. Shaft 54 is supported for rotation in trunnion 60 that is affixed to tumbling container 58, shown in dashed lines for clarity. Screens 64*a*, 64*b* and end frames 46*a*, 46*b* are rigidly connected to trunnion 60, therefore tumbling in synchronization with container 58. The paddles (not visible) are supported for rotation with shaft 54 in trunnion 60. A drive means, e.g. a variable speed pneumatic motor, is connected to shaft 54 for causing the paddles to rotate at a speed independent of the speed of tumbling of container 58, including rotating the paddles in a different direction relative to screen 64*a*, 64*b*.

Figure 8A:
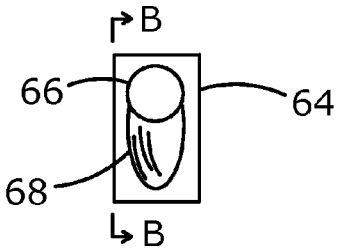
FIG. 8A is a front elevation view of a section of screen showing an enlarged single opening and cowl.
Figure 8B:
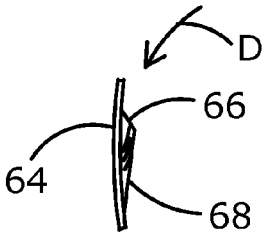
FIG. 8B is a side elevation view of the single opening and cowl of FIG. 8A taken in the direction of line B-B.

Referring now to FIGS. 8A and 8B, an enlarged elevation view is shown of a typical single grating screen section 64 in front and side views, respectively. FIG. 8B is taken in the direction of line B-B of FIG. 8A. Grating screen section 64 is formed by combined punching to form an opening 66 and pressing to form cowl 68. The open edge of cowl 68 adjacent to opening 66 provides a grating surface for breaking up powder lumps. Each cowl 68 is similarly oriented in the circumferential direction. As seen in FIG. 8B, screen section 64 is arcuate in form, and cowl 68 extends inward of the curvature thereof. In this arcuate configuration with cowl 68 on the inside surface of cutting screen 64, as the paddles rotate (see FIG. 4), the powder being sifted and blended is pressed into the edge of cowl 68 to disintegrate lumps and improve the blending. As noted above, the paddles within the screen may be driven in a selected rotational direction to force the powder in the direction indicated by arrow D to press against the open end of cowl 68, effectively breaking down any powder lumps that may exist.

Referring further to FIG. 7, first grating screen 64*a* is formed with a relatively open pattern of relatively large openings and second grating screen 64*b* is formed with a relatively dense pattern of relatively small openings. The combination of a coarse pattern and a finer pattern of openings provides improved disintegration of lumps as powder comes into contact with each screen section. In addition, the present invention is adaptable to different numbers of screen segments, e.g. 3 or 4 screen segments. In the case of a screen having more than 2 segments, there may be either multiple varieties of screen density or different pattern of screen alternation, e.g. a coarser screen on either end and a finer screen in the middle area. It is further understood that sifting and blending apparatus would benefit from forming the screen with openings and cowls as described above in cases utilizing a single piece screen.

While the description above discloses preferred embodiments of the present invention, it is contemplated that numerous variations and modifications of the invention are possible and are considered to be within the scope of the claims that follow.

What is claimed is:

1. An apparatus for alternately sifting and blending powders in the same operation, comprising:

a. a first screen section;

b. a second screen section configured for being assembled in alignment with the first screen section;

c. a first end frame configured to be removeably assembled to the first screen section;

d. a second end frame configured to be removeably assembled to the second screen section;

e. means for assembling the first end frame, the first screen section, the second screen section and the second end frame together;

f. a first agitator section;

g. a second agitator section configured for being assembled coaxially to the first agitator section between the first and the second end frames; and h. a shaft for mounting the first and second agitator sections for rotation;

i. whereas the end frames and the screen sections are removeably assembled within a tumbling container for rotation therewith, and the agitator sections are assembled to each other on the shaft, the shaft mounted to the tumbling container for independent rotation relative thereto.

2. The apparatus described in claim 1, wherein the first and second screen sections are arcuate in configuration about an axis and the first and second agitator sections comprise paddles that are mounted around the axis to rotate in proximity to the screen sections.

3. The apparatus described in claim 2, wherein the paddles comprise vanes formed with an array of openings therethrough.

4. The apparatus described in claim 3, wherein the first paddle vanes and the second paddle vanes are formed with distal edges at an angle to a radial length thereof.

5. The apparatus described in claim 1, the first and second curved screen sections being formed with an array of openings therethrough, each opening having a cowl formed adjacent thereto.

6. The apparatus described in claim 5, wherein the cowls are formed to extend radially interior of the screen sections.

7. The apparatus described in claim 6, wherein the cowls are formed with their open edges facing in the same circumferential direction.

8. The apparatus described in claim 1, wherein the first screen section and the second screen section each comprise a plurality of sleeves aligned substantially parallel to an axis of curvature of the screen section.

9. The apparatus described in claim 8, further comprising a plurality of rods for passing through the sleeves.

10. The apparatus described in claim 1, wherein the means for assembling the first end frame, the first screen section, the second screen section and the second end frame comprises a rod with fastening means.

11. The apparatus described in claim 1, further comprising means for rotating the first and second agitator sections relative to the first and second screen sections.

12. The apparatus described in claim 11, wherein the means for rotating the first and second agitator sections is capable of rotating at different speeds and in different rotational directions.

13. An apparatus for alternately sifting and blending powders in the same operation, comprising:

a. a container mounted for rotation around an axis, the container having an access opening;

b. a first curved screen section configured for passing through the access opening;

c. a second curved screen section configured for passing through the access opening and configured for being assembled within the container to the first curved screen section such that the first and second screen sections are mounted side by side along the axis;

d. the first and second curved screen sections being formed with an array of openings therethrough; and e. a paddle for rotatably mounting in axial alignment with the first and second curved screen sections.

14. The apparatus described in claim 13, wherein the paddle is formed with multiple sections aligned with each other.

15. The apparatus described in claim 13, further comprising a cowl formed adjacent to each opening wherein the cowls are formed to extend radially interior of the screen sections.

16. The apparatus described in claim 15, wherein the cowls are formed with their open edges facing in the same circumferential direction.

17. The apparatus described in claim 13, further comprising means for rotating the paddle relative to the first and second screen sections.

18. The apparatus described in claim 17, wherein the means for rotating the paddle is capable of rotating at different speeds and in different rotational directions.

19. The apparatus described in claim 13, wherein the first screen section is formed with relatively large openings in a coarse pattern and the second screen section is formed with relatively small openings in a fine pattern.

20. The apparatus described in claim 13, wherein the paddle is formed with a cutting edge on one side and a blunt edge on the opposite side, the direction of rotation of the paddle being reversible.

21. The apparatus described in claim 13, wherein the paddle is formed with vanes having an array of openings therethrough.

* * * * *